US011438971B2

(12) United States Patent
Chen

(10) Patent No.: US 11,438,971 B2
(45) Date of Patent: Sep. 6, 2022

(54) HIGH-PERFORMANCE FAR-INFRARED SURFACE HEATING ELEMENT OF CARBON COMPOSITE MATERIAL AND APPLICATION THEREOF

(71) Applicant: SUZHOU HANANO MATERIALS TECHNOLOGY LTD., Suzhou (CN)

(72) Inventor: Xinjiang Chen, Suzhou (CN)

(73) Assignee: SUZHOU HANANO MATERIALS TECHNOLOGY LTD., Suzhou (CN)

( * ) Notice: Subject to any disclaimer, the term of this patent is extended or adjusted under 35 U.S.C. 154(b) by 403 days.

(21) Appl. No.: 16/494,679

(22) PCT Filed: Jul. 31, 2017

(86) PCT No.: PCT/CN2017/095195

§ 371 (c)(1),
(2) Date: Sep. 16, 2019

(87) PCT Pub. No.: WO2018/166137

PCT Pub. Date: Sep. 20, 2018

(65) Prior Publication Data

US 2020/0015323 A1 Jan. 9, 2020

(30) Foreign Application Priority Data

Mar. 16, 2017 (CN) ..... 201720256327.4

(51) Int. Cl.
*H05B 3/14* (2006.01)
*H05B 3/36* (2006.01)

(52) U.S. Cl.
CPC ..... *H05B 3/145* (2013.01); *H05B 3/36* (2013.01); *H05B 2203/032* (2013.01)

(58) Field of Classification Search
CPC ..... H05B 3/145; H05B 3/36; H05B 3/342; H05B 3/34; H05B 3/146; H05B 3/16;
(Continued)

(56) References Cited

U.S. PATENT DOCUMENTS 5,925,275 A * 7/1999 Lawson ..... B64D 15/12 219/543
2016/0302264 A1* 10/2016 Kessler ..... H05B 3/20
(Continued)

FOREIGN PATENT DOCUMENTS

CN 2924991 * 7/2007
CN 107565123 * 12/2016

*Primary Examiner* — Shawntina T Fuqua
(74) *Attorney, Agent, or Firm* — Bayramoglu Law Offices LLC

(57) ABSTRACT

The present application discloses a high-performance far-infrared surface heating element of carbon composite material and application thereof. The surface heating element comprises: a carbon composite material layer comprising a film-like material consisted of an $sp^2$ hybrid structure carbon material; and thermal stable electronic insulating layer provided on opposite sides of the carbon composite material layer. The surface heating element of the present application has the characteristics of flexibility, high strength, high stability, high safety, etc., and has excellent flame retardancy, no harmful electromagnetic, no circuit protection module, economical, safe and practical characteristics, and no safety hazard; it can be used as a direct surface heating source in the field of low-voltage electric heating, such as a civil heating device used in the preparation of a floor heating device, an electric heating carpet, an electric heating mattress or a heater, as well as an industrial heating device for lithium battery modules and industrial pipe heating elements.

20 Claims, 2 Drawing Sheets

(58) Field of Classification Search
CPC ..... H05B 2203/032; H05B 2203/013; H05B 2203/026; H05B 2214/03; H05B 2214/04; F24D 13/02
See application file for complete search history.

(56) References Cited

U.S. PATENT DOCUMENTS

2018/0279416 A1* 9/2018 Sajic ..... H05B 3/342
2018/0370637 A1* 12/2018 Hu ..... H05B 3/286

* cited by examiner

HIGH-PERFORMANCE FAR-INFRARED SURFACE HEATING ELEMENT OF CARBON COMPOSITE MATERIAL AND APPLICATION THEREOF

This application is the national phase entry of International Application No. PCT/CN2017/095195, filed on Jul. 31, 2017, which is based upon and claims priority to Chinese Patent Application No. 201720256327.4, filed on Mar. 16, 2017, the entire contents of which are incorporated herein by reference.

TECHNICAL FIELD

The present application relates to a carbon composite material, and more particularly to a high-performance far-infrared surface heating element of carbon composite material and its application in the field of surface heating.

BACKGROUND

The surface heating element is a film heating element which can generate heat on the whole surface after being energized. Traditional surface heating elements commonly comprise a metal foil heating sheet, a resistance wire heating pad, a PTC heating plate, and a surface heating film of carbon material. The surface heating element is mainly used in the fields of civil heating, flexible heating wearing and industrial heating. The field of civil heating has the advantages of being comfortable, environmentally friendly, energy efficient, maintenance-free, independent using of each room, and long in life, compared with traditional heating technologies such as plumbing. However, the biggest disadvantage of the metal foil heating sheet, the resistance wire heating pad, and the PTC heating plate compared with the surface heating film of carbon material is that the uniformity of heating is not high, and the wire generates harmful electromagnetic waves due to the flow of electrons, thereby generating an adverse effect on the human body in this environment for a long time. The heating film of carbon material is a heating element of a planar carbon material, which has uniform heat generation and no harmful electromagnetic radiation. Compared with metal foil heating sheet, resistance wire heating pad, PTC heating plate, and the surface heating film of carbon material, the field of industrial heating (such as lithium battery module heating and industrial pipe heating) has the advantages of being light, soft, and easy to install; and the surface heating element of carbon material has a uniform temperature, and is more suitable for applications requiring high surface temperature uniformity; in addition, the surface heating element of carbon material is heated by far-infrared radiation, and the heating effect is better.

The surface heating element of carbon material is a far-infrared surface heating element formed by applying parallel electrodes at both ends and insulating as a whole using a conductive material such as graphite, graphene, carbon fiber, carbon nanotubes, and fullerene as a surface heat source. However, the currently reported heating elements of carbon material have the following disadvantages: 1. they are limited by the nature of the carbon materials themselves and the dispersion forming process, and generally have a high conductive resistance, resulting in lower power density; in the field of underfloor heating, in order to achieve the purpose of rapid heating, a high voltage (i.e., universal 220V (China) or 110V (US, Japan, Europe, etc.)) is used for heating at this stage. The heating power is generally 50~250 W/m$^2$; 2. the strength of carbon composite conductive material is lower, the film will be cracked after repeated bending, leading to a high risk of sparking after energization; 3. the surface heating element has a simple structure, and under very harsh test conditions (such as damp heat, ultraviolet light, salt mist, thermal shock), the heating film is prone to have the risk of life degradation, even delamination of the heat insulating layer, leakage, and the like.

In view of this, it is indeed necessary to provide a high-performance far-infrared surface heating element of carbon composite material, which has high conductivity, high strength and high stability, and is applied to the surface heating field.

SUMMARY

The main object of the present application is to provide a high-performance far-infrared surface heating element of carbon composite material and its application in the field of surface heating to overcome the deficiencies in the prior art.

To achieve the above object, the technical solution adopted by the present application comprises the following content.

The embodiment of the present application provides a high-performance far-infrared surface heating element of carbon composite material, comprising:

a carbon composite material layer, comprising a film-like material mainly consisted of an sp$^2$ hybrid structure carbon material, wherein the film-like material has high electrical conductivity and a surface resistance of 0.01 Ω/sq to 100 Ω/sq and a power density of 50~10000 W/m$^2$ at a driving voltage of 1 to 1000 V; and particularly preferably, the film-like material can achieve low voltage (60V and less) heating, and the film-like material may have a surface resistance of 0.01 Ω/sq to 10 Ω/sq and a power density of 50~3000 W/m$^2$ at a driving voltage of ≤60V.

The carbon composite material layer has a strength of 50 to 2000 MPa, and has excellent flexibility, and the resistance is maintained at 95% or more after bending for a million times; and A thermal stable electronic insulating layer provided on opposite sides of the carbon composite material layer in order to improve the resistance on damp heat, ultraviolet light and salt mist of the heating element.

The embodiment of the present application further provides the application of any of the above high-performance far-infrared surface heating elements of carbon composite material in the field of surface heating.

For example, some embodiments of the present application provide the use of any of the high-performance far-infrared surface heating elements of carbon composite material described above in the preparation of the civil heating products such as a baseboard heater, a floor heating structure, a wall heating structure, an electric heating household item, a flexible heating wearing, and an electric boiler, and in the industrial application of a lithium battery module heating element, an industrial pipe heating element, and an industrial device heating element.

Compared with the prior art, the advantages of the present application comprise the following content.

1. The high-performance far-infrared surface heating element of carbon composite material provided by the present application has the characteristics of flexibility, high strength and high stability, and has excellent flame retardancy, heat conversion efficiency up to 99% or more, energy conservation, no harmful electromagnetic radiation, safety and environmental protection. In particular, the surface heating element has excellent electrical conductivity and can have a power density of 50 to 10000 W/m$^2$ at 1 to 1000 V, especially a power of 50 to 3000 W/m$^2$ below the safe voltage (60 V or less). No circuit protection module is required. The surface heating element is economical, safe and practical, and there are no safety hazards.

2. The high-performance far-infrared surface heating element of carbon composite material provided by the present application can be used as a direct-surface heating source in the field of electric heating, such as an air convection heater, a floor heating structure, a wall heating structure, an electric heating household item, flexible heating wearing, an electric boiler, a lithium battery module heating element, an industrial pipe heating element, an industrial device heating element, etc.

BRIEF DESCRIPTION OF THE DRAWINGS

In order to more clearly illustrate the embodiments of the present application or the technical solutions in the prior art, the drawings to be used in the embodiments or the prior art description will be briefly described below. Obviously, the drawings in the following description are merely some embodiments described in the present application. Other drawings can be obtained from those skilled in the art without any creative work.

DESCRIPTION OF THE EMBODIMENTS

Figure 1A:
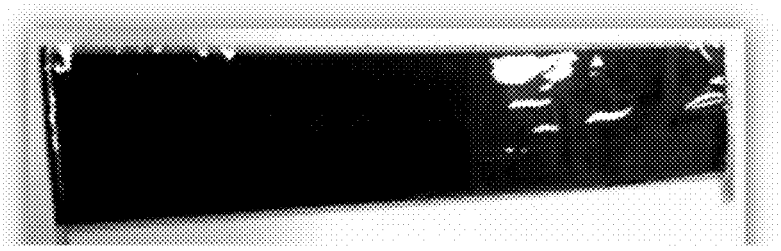
FIGS. 1*a*-1*b* are photographs and schematic diagrams illustrating the structure of a high-performance far-infrared surface heating element of carbon composite material according to an exemplary embodiment of the present application.

In view of the deficiencies in the prior art, the inventors of the present invention have been able to present the technical solutions of the present application through long-term research and extensive practice, and the technical solution, its implementation process and principle, etc. will be further explained as follows.

An embodiment of the present application provides a high-performance far-infrared surface heating element of carbon composite material, comprising:

a carbon composite material layer, comprising a film-like material mainly consisted of an sp$^2$ hybrid structure carbon material, wherein the film-like material has a surface resistance of 0.01 Ω/sq to 100 Ω/sq and a power density of 50~10000 W/m$^2$ at a driving voltage of 1 to 1000 V; and thermal stable electronic insulating layer provided on opposite sides of the carbon composite material layer.

More preferably, the surface heating element has a thickness of 1 μm to 2 mm.

Preferably, the film-like material has a surface resistance of 0.01 Ω/sq to 10 Ω/sq and a power density of 50~3000 W/m$^2$ at a driving voltage of ≤60V.

Further, the film-like material has a power density of 50 to 3000 W/m$^2$ at a driving voltage of ≤6V, 12V, 24V, 36V or 42V.

Further, the film-like material has the characteristics of flexibility, high strength, and high stability. Specifically, when being bent more than one million times, the film-like material has a surface resistance of being maintained at 95% or more, a tensile strength of 50~2000 MPa, a thickness of 1~1000 μm, a temperature rise of 10° C.~250° C., and a high temperature and high humidity resistance change of <5%.

High temperature and high humidity means: 85° C. & 90 RH %, 240H.

Further, the microstructure of the film-like material may be a layered structure formed by stacking a sheet material (for example, graphene), or a network structure consisted of a one-dimensional linear or tubular material (for example, a carbon composite material).

Further, the layered structure is a graphene film or a composite film of graphene and a resin. Preferably, the graphene in the layered structure has a spacing of >0.34 nm. Preferably, the layered structure has a thickness of 1 μm to 500 μm.

Further, the network structure is a film of carbon composite material, a composite film of a carbon composite material and a resin, a carbon fiber film, or a composite film of a carbon fiber and a resin. Preferably, the network structure has a pore having a pore diameter of 1 nm to 50 nm. Preferably, the network structure has a thickness of 1 μm to 500 μm.

Further, the long-term temperature resistance of the thermal stable electronic insulating layer is 200 to 250° C., the short-term temperature resistance is 300° C., the thickness is 10 to 1000 μm, and the breakdown voltage is greater than 2 KV.

The carbon material of the sp$^2$ hybrid structure used in the present application has good conductivity due to the conjugated electron cloud structure, and in the case of being energized, a large amount of heat is generated due to friction and collision between carbon atoms. The heat is mainly released in the manner of far-infrared radiant energy with a wavelength of 5 to 15 microns and conducting heat, and the total electric heating conversion efficiency is as high as 99% or more.

The carbon material having the sp$^2$ hybrid structure suitable for the present application mainly comprises any one of or a combination of two or more of a carbon composite material, graphene, carbon fiber, graphite, and conductive carbon black.

For example, the film-like material may comprise any one of or a combination of two or more of a heating film of pure carbon composite material (such as a product after PI film is carbonized and graphitized), a composite heating film of carbon composite material, an artificial graphite sheet heating film, a graphene heating film, a graphene composite heating film, a graphite composite heating film, a pure carbon fiber woven heating film, and a carbon fiber composite heating film.

In some embodiments, the film-like material is formed on the surface of the substrate in at least one manner of printing, coating, spraying, and aerosol.

In some embodiments, the surface of the carbon composite material layer is provided with a high-performance electronic insulating layer that can improve the resistance on damp heat, ultraviolet light, salt mist, and thermal shock of the carbon composite material layer.

Preferably, the high-performance electronic insulating layer is consisted of a polymer material having excellent high density, such as a UV hardening coating, a heat curing hardening coating, a primer coating, and a top coating. The constituent material thereof comprises any one of or a combination of two or more of an epoxy resin, a rubber, an acrylic resin, a polyurethane resin, and a silicone resin.

In some embodiments, the high-performance electronic insulating layer is attached to the surface of the film-like material in at least one manner of printing, coating, spraying, and aerosol.

In some embodiments, both ends and/or both sides of the carbon composite material layer are provided with at least parallel electrodes for applying a voltage.

As one of the preferred embodiments, the insulating layer is consisted of a polymer material having excellent temperature resistance, and is fit to the carbon composite material layer in any one of manners of spraying, coating, a rubberized protective film adhered on both sides, and a hot-pressed thermosetting adhesive film.

More preferably, the coating has excellent temperature resistance, and may be an epoxy resin binder or an elastic resin (such as a rubber elastomer), or any one of or a combination of two or more of an epoxy resin, an acrylic resin, a polyurethane resin, and a silicone resin, but is not limited thereto.

Further, the rubberized protective film comprises a substrate and an adhesive layer, and has excellent temperature resistance.

Further, the thermosetting adhesive film comprises a substrate and a thermosetting adhesive, and the thermosetting adhesive is any one of an epoxy thermosetting adhesive, an acrylic thermosetting adhesive, an EVA thermosetting adhesive, and a PUR thermosetting adhesive.

The substrate comprises any one of or a combination of two or more of PET (polyethylene terephthalate), PI (polyimide), PDMS (polydimethylsiloxane), PMMA (polymethyl methacrylate), PP (polypropylene) and PC (polycarbonate), but is not limited thereto.

The adhesive layer may be an epoxy resin binder or an elastic resin (such as a rubber elastomer), or any one of or a combination of two or more of an epoxy resin, an acrylic resin, a polyurethane resin, and a silicone resin, but is not limited thereto.

In some embodiments, the thermal stable electronic insulating layer is bonded to the surface of the substrate or the surface of the film-like material in at least one manner of printing, coating, spraying, and aerosol.

The high-performance far-infrared surface heating element of carbon composite material of the present application can be used as a surface heat source, and has a power density of 50~10000 W/m$^2$ at the driving voltage of 1~1000V; especially at low voltage, especially at a safe voltage, has a power density of 50~3000 W/m$^2$ and a thermal conversion efficiency of 99% or more. The heating element requires no circuit protection module with economical, safe and practical characteristics, and has excellent flame retardancy, no harmful electromagnetic with safe and environmentally friendly characteristics.

The embodiment of the present application further provides a heating element of carbon composite material, comprising a heating film of carbon composite material and a heat sink, wherein at least one side surface of the heating film of carbon composite material is attached and thermally connected to the heat sink, and the heating film of carbon composite material is electrically connected to the electrode, wherein the heating film of carbon composite material comprises a film of carbon composite material formed by aggregation of a plurality of carbon composite materials.

In some embodiments, two opposite side surfaces of the heating film of carbon composite material are attached and thermally connected to the heat sink so as to more efficiently transfer heat generated by the film of carbon composite material through the heat sink.

In some embodiments, the heating film of carbon composite material may have a planar structure or a curved structure, but the latter is preferably used, which can have a larger heat generating area and heat dissipating area in the same space, and is particularly suitable for heating in cooperation with fluid such as air and water.

The above curved surface structure may be a streamlined curved surface structure or a folding-line curved surface structure with an inflection point.

In some preferred embodiments, the heating film of carbon composite material has a paper-folded structure.

Further, an angle formed between the two parts of the heating film of carbon composite material separated by any one of the fold lines is preferably 5° to 170°, and particularly preferably 10° to 45°.

Preferably, any of the fold lines on the heating element of carbon composite material extends along the direction of travel of the airflow in the airflow passage, thereby facilitating rapid conduction of heat on the one hand and obstructing no flow of air on the other hand.

In the present specification, "integral thickness" can be understood as the height of an object having a fixed shape when lying flat, and the length and width of the object should be greater than, and in particular, much greater than its height.

In some preferred embodiments, the heat sink has a thin-walled curved structure, which can have a larger surface area in the same space than a planar structure, and is particularly suitable for heating in cooperation with a fluid such as air or water.

Further, the heat sink preferably adopts a paper-folded structure.

Still further, an angle formed between the two parts of the heat sink separated by any one of the fold lines is preferably 5° to 170°, and particularly preferably 10° to 45°.

In some preferred embodiments, the heat sink has an overall thickness of 0.01 to 50 mm.

Further, the heat sink may comprise a metal foil or a graphite sheet (natural graphite or artificial graphite sheet) or the like, and may be, for example, a copper foil or an aluminum foil or a ceramic heat sink, an aluminum fin heat sink, or the like, and is not limited thereto.

In some more specific embodiments, the heating element of carbon composite material comprises a heating element of carbon composite material and two heat sinks, and the heating film of carbon composite material is sandwiched between two heat sinks.

In some preferred embodiments, the heating element of carbon composite material is a paper-folded structure as a whole.

Further, the heating element of carbon composite material has an overall thickness of preferably 50 to 150 mm, and particularly preferably 70 to 100 mm.

Further, the heating element of carbon composite material has an overall thickness of 0.1 to 50 mm, preferably ≤10 mm, particularly preferably more than 0 and less than 8 mm.

Further, the heating element of carbon composite material has a power of 10 to 1000 W/m, preferably 50 to 500 W/m, and particularly preferably 50 to 200 W/m.

The high-performance far-infrared surface heating element of carbon composite material of the present application can be applied as a direct-surface heating source in the field of electric heating.

The embodiments of the present application provide the use of the high-performance far-infrared surface heating element of carbon composite material described above in the preparation of a civil heating device or an industrial heating device.

Preferably, the civil heating device comprises a baseboard heater, a floor heating structure, a wall heating structure, an electric heating household item, a flexible heating wearing, and an electric boiler.

Preferably, the industrial heating device comprises a lithium battery module heating element, an industrial pipe heating element, and an industrial device heating element.

The specific embodiments of the present application are described in detail below with reference to the drawings so that the object, technical scheme and advantages of the present application are clearer. Examples of these preferred embodiments are illustrated in the drawings. The embodiments of the present application shown in the drawings and described in the drawings are merely exemplary, and the present application is not limited to the embodiments.

It should also be noted that, in order to avoid obscuring the present application due to unnecessary detail, only the structures and/or processing steps closely related to the solution according to the present application are shown in the drawings, and other details less related to the present application are omitted.

Figure 1B:
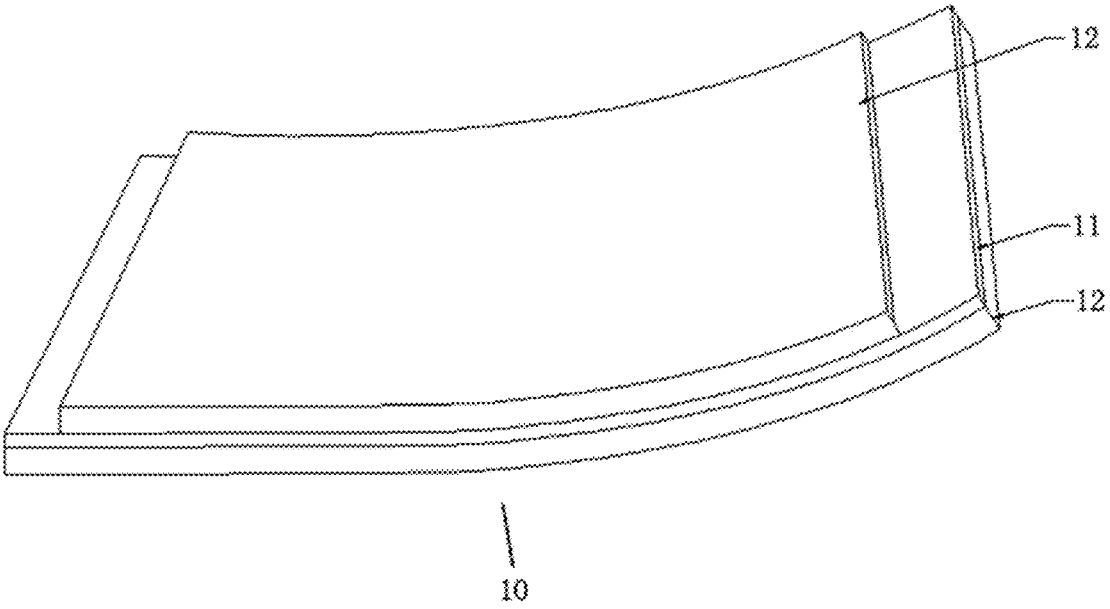

Refer to FIG. 1*a*-FIG. 1*b*, which are photographs and schematic diagrams illustrating the structure of a far-infrared surface heating element 10 of high-performance carbon composite material according to an exemplary embodiment of the present application. The heating element mainly comprises a carbon composite material layer 11 and polymer material insulating layers 12 which are excellent in temperature resistance and located two sides thereof.

The carbon composite material layer 11 comprises a film-like material (preferably consisted of the carbon material, for example, a film of carbon composite material, a graphene film, etc.) mainly consisted of an $sp^2$ hybrid structure carbon material (one or more of carbon composite material, graphene, carbon fiber, graphite and conductive carbon black, preferably such as carbon composite material) or the carbon material and other materials. The film-like material preferably has a thickness of 1 to 1000 μm, and the microscopic structure may be a layered structure formed by stacking sheet materials, or a network structure consisted of one-dimensional linear or tubular materials. Further, the film-like material has the characteristics of flexibility, high strength, high stability, and the like. For example, when being bent more than one million times, the film-like material has a surface resistance of being maintained at 95% or more, a tensile strength of 50~2000 MPa, a thickness of 1~1000 μm, a temperature rise of 10° C.~250° C., and a high temperature and high humidity (85° C. & 90 RH %, 240H) resistance change of <5%.

The polymer material barrier insulating layer 12 may be mainly consisted of a polymer material having excellent temperature resistance (for example, one or more of an epoxy resin, a rubber, an acrylic resin, a polyurethane resin, and a silicone resin). The insulating layer has a thickness of preferably 10~1000 μm, a long-term temperature resistance of 200 to 250° C., a short-term temperature resistance of 300° C., a thickness of 10 to 1000 μm, and a breakdown voltage of greater than 2 KV.

Further preferably, the surface heating element has a thickness of 1 μm to 2 mm, and has the characteristics of good flexibility, high strength, high stability, high flame retardancy. The power density is 50 to 10000 W/m$^2$ at 1 to 1000 V. The power can be up to 50~3000 W/m$^2$ below the safe voltage (60V), the heat conversion efficiency is 95% or more, especially 99% or more. The surface heating element has no harmful electromagnetic, and is safe and environmentally friendly, economical, safe and practical, and there is no safety hazard.

Figure 2A:
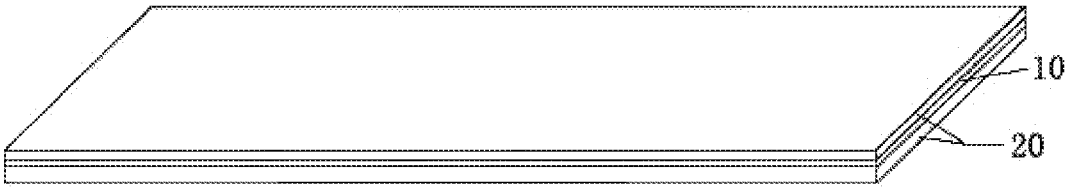
FIG. 2*a* is a schematic diagram illustrating a low-voltage electric heating structure based on a far-infrared surface heating element of a high-performance carbon composite material according to an exemplary embodiment of the present application.
Figure 2B:
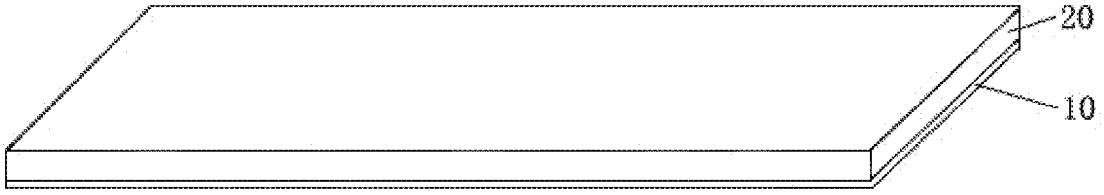
FIG. 2*b* is a schematic diagram illustrating another low-voltage electric heating structure based on a far-infrared surface heating element of a high-performance carbon composite material according to an exemplary embodiment of the present application.

Refer to FIG. 2*a* and FIG. 2*b*, which are structural diagrams of an electric heating product based on a high-performance far-infrared surface heating element of carbon composite material according to some exemplary embodiments of the present application. For example, there are two types of product structures: as shown in FIG. 2*a*, the surface heating element 10 of high-performance carbon composite material is located under the floor/baseboard/carpet/mattress 20. Alternatively, as shown in FIG. 2*b*, the surface heating element 10 of high-performance carbon composite material is located within the floor/baseboard/carpet/mattress 20.

Figure 3:
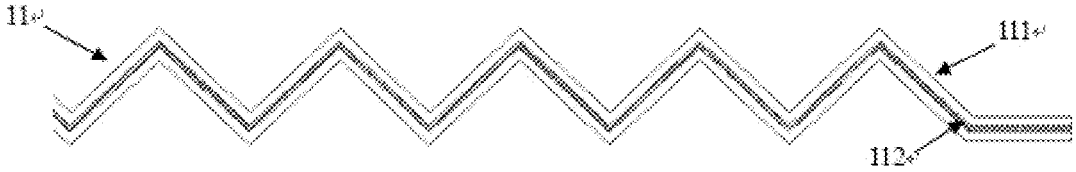
FIG. 3 is a schematic diagram illustrating the structure of a heating element of carbon composite material according to an exemplary embodiment of the present application.

Refer to FIG. 3, which illustrates a heating element 11 of carbon composite material according to some exemplary embodiments of the present application. The heating element has a paper-folded structure as a whole, comprising a continuous heating film 111 of carbon composite material and two heat sinks 112. The heating film of carbon composite material is sandwiched between the two heat sinks and thermally connected to the heat sink, while the heating film of carbon composite material is also electrically connected to the electrodes (not shown). The heating film of carbon composite material comprises a film of carbon composite material formed by aggregation of a plurality of carbon composite materials. The film of carbon composite material can be prepared by physical or chemical deposition, or can be obtained by commercially available means or the like.

In order to improve the operating safety performance of the heating element of carbon composite material, as described above, an insulating film or the like (not shown) may be provided between the heating film of carbon composite material and the heat sink.

Figure 4:
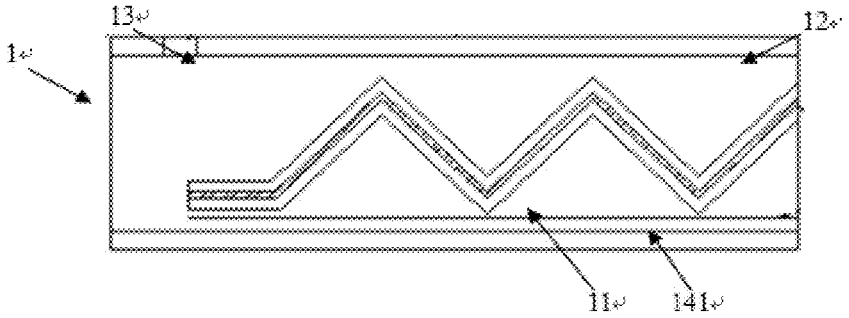
FIG. 4 is a schematic diagram illustrating the structure of a baseboard heater of carbon composite material according to an exemplary embodiment of the present application.

Refer to FIG. 4, which illustrates a baseboard heater 1 constructed based on the above heating element of carbon composite material, which may comprise a housing 12 and a heating element 11 of carbon composite material mounted within the housing 12. The upper part and the lower part of the housing may be provided with one or more air outlets and one or more air inlets (not shown), respectively. The housing may also be provided with a mounting hole 13 and the like matched with the connecting piece, so that the baseboard heater 1 can be fixed to a wall or the ground. Meanwhile, the baseboard heater 1 may further comprise an intelligent thermostat 14 or the like. The structure of the intelligent thermostat 14 may be as described above. For example, a linear overheating protection switch 141 or the like may be included therein.

Obviously, the baseboard heater 1 may also comprise other components as previously described, or other components that are conventional in the industry, which will not be described herein.

The overall thickness of the baseboard heater 1 can be controlled to be 8 to 100 mm, more preferably 10 to 80 mm, and particularly preferably 30 to 80 mm. At the same time, the overall height of the baseboard heater 1 can be controlled to be 60 to 200 mm, more preferably 70 to 150 mm, and particularly preferably 100 to 120 mm.

Figure 5:
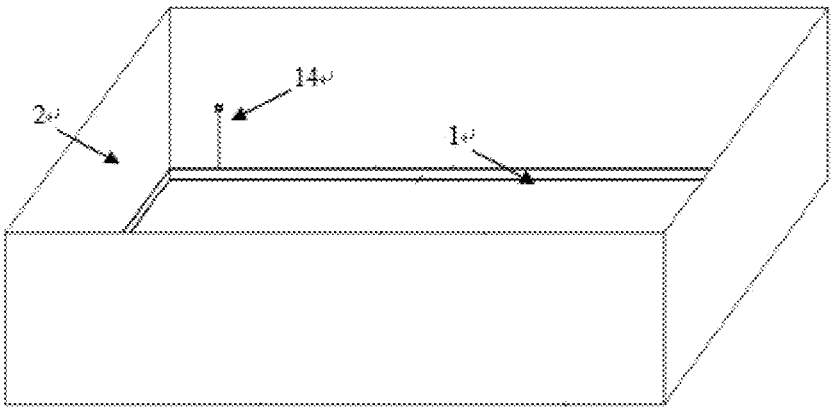
FIG. 5 is a schematic diagram illustrating the application of a baseboard heater of carbon composite material according to an exemplary embodiment of the present application.

Referring to FIG. 5, if the baseboard heater 1 is arranged around the room 2, the heating area can be greatly improved, the power density and the surface temperature of the baseboard heater can be reduced, and it is safer. At the same time, it will not take up too much indoor space and no storage problems need to be taken into account.

In this embodiment, the heating film of carbon composite material is combined with a heat sink such as a metal foil or natural graphite or artificial graphite to form a "folding-fan" heating element of carbon composite material after being folded. The characteristics of the surface heating element of carbon composite material are fully utilized to transfer the heat in the most efficient way, greatly increasing the heating area and the heat exchange area with the air, greatly improving the heat dissipation performance and thereby minimizing the energy consumption; in addition, the housing of the baseboard heater is provided with upper and lower air outlets, which can effectively generate air convection, so that the heat can be dissipated to the surrounding environment in time; the heating element is connected to the intelligent temperature controller terminal, which can be remotely controlled, fully reduce the waste of electric energy, create an intelligent community, and achieve energy conservation and emission reduction.

Embodiment 1

In some embodiments, a floor heating structure or wall heating structure is provided, comprising:

a floor or a floor tile provided on the ground, or a baseboard provided on the wall surface; and a high-performance far-infrared surface heating element of carbon composite material provided under or above the floor or floor tile as describe above, or a high-performance far-infrared surface heating element of carbon composite material provided on the surface of the baseboard or between the baseboard and the wall surface as describe above.

Further, the floor or the wall surface is further provided with a heat insulating layer, and the surface heating element of high-performance carbon composite material is provided between the heat insulating layer and the floor or the floor tile or the baseboard.

Further, the floor or the floor tile or the baseboard is further provided with a decorative layer, and the surface heating element of high-performance carbon composite material is provided between the decorative layer and the floor or the floor tile or the baseboard.

Further, the floor, the floor tile or the baseboard comprises a solid wood floor, a solid wood multi-layer floor, a laminate floor, a tile, a marble slab or a brick, or a PVC board, but is not limited thereto.

In some specific embodiments, the surface heating element of high-performance carbon composite material can be applied to the floor heating field as a direct surface heating source, and there are two types of structures: a) the same as the existing plumbing and electric heating methods, the heating element is located under the floor or the floor tile and above the laid heat insulating layer after the concrete floor is leveled; b) the heating element is located above the existing floor, but is laid with a decorative floor or a similar structure thereon.

Embodiment 2

In some embodiments, an electric heating household item is provided, comprising:

a fabric or leather, and a surface heating element of high-performance carbon composite material as described above, which is bonded to the surface of the fabric or leather and/or provided inside the fabric or leather.

Further, the electric heating household item comprises an electric heating carpet, the electric heating carpet comprises a carpet body, and the surface heating element of high-performance carbon composite material is provided below the carpet body or inside the carpet body.

Further, the electric heating household item comprises an electric heating mattress, the electric heating mattress comprises a mattress body, and the surface heating element of high-performance carbon composite material is provided below the mattress body or inside the mattress body.

Further, the electric heating household item comprises a piece of electric heating wallpaper, the electric heating wallpaper comprises a wallpaper body, and the surface heating element of high-performance carbon composite material is provided at the inner side (i.e., the side near the wall) of the wallpaper body or inside the wallpaper body.

Further, the electric heating household item comprises an electric heating mural, the electric heating mural comprises a mural body, and the surface heating element of high-performance carbon composite material is provided at the inner side (i.e., the side near the wall) of the mural body or inside the mural body.

Embodiment 3

The embodiment of the present application further provides a baseboard heater of carbon composite material, comprising:

a housing having an air inlet and an air outlet, wherein the air inlet and the air outlet are in communication with an airflow passage distributed in the housing;

the heating element of carbon composite material, wherein at least one heat sink is at least partially arranged in the airflow passage;

a connector configured to fixedly connect the housing to the wall and/or the ground.

In some embodiments, the housing may also be provided with an automatic baffle at least configured to be engaged with the air inlet and/or the air outlet. The automatic baffle can be completely closed when the heater is not in operation and automatically opened during operation to ensure that foreign matter such as dust, hair, etc., will not be in contact with the heating element of carbon composite material to result in dirt or odor when heated.

In some embodiments, the baseboard heater of carbon composite material may further comprise an electrostatic precipitator and/or a negative ion generating device to eliminate dirt in the air and purify the indoor environment while heating.

Further, the electrostatic precipitator or the negative ion generating device is at least partially arranged within the airflow passage, alternatively, the electrostatic precipitator is distributed at the air inlet and/or the air outlet, or the negative ion generating device is distributed at the air outlet.

In some preferred embodiments, a heat insulating reflective film is provided between the inner wall of the housing and the heating element of carbon composite material, so that the heat generated by the heating element of carbon composite material can be transferred to the air as much as possible on the one hand, and on the other hand, it is also possible to prevent the temperature of the housing from being too high due to heat conducted to the housing, so as to prevent the user from being burnt.

Further, the heat insulating reflective film may be provided on an inner wall of the housing.

In some preferred embodiments, the air outlet and the air inlet are provided at an upper part and a lower part of the housing, respectively, so that air convection can be more effectively generated between the inside of the heater and the surrounding environment when the heater is in operation so as to dissipate heat to the surrounding environment in time.

In some embodiments, the baseboard heater of carbon composite material can further comprise an intelligent thermostat, which is connected with the heating film of carbon composite material.

Further, the intelligent thermostat may comprise a temperature controller, a temperature sensor, and a power regulating component, wherein the temperature sensor is at least configured to monitor the temperature of the heating film of carbon composite material and/or the surrounding environment, both of the temperature sensor and the power regulating component are connected to the temperature controller, and the power regulating component is also connected to the heating film of carbon composite material.

The temperature controller, the temperature sensor and the power regulating component can all use the components known in the industry, and can be obtained by commercially available means or the like.

Still further, the intelligent thermostat further comprises an overheating protection device, which is connected to the temperature controller.

The overheating protection device may comprise a point-like overheating protection switch, a block-like overheating protection switch or a linear overheating protection switch, and is not limited thereto.

Still further, the overheating protection device may be provided in the housing.

Still further, the intelligent thermostat may further comprise a wireless communication module, and the temperature controller is connected to the wireless communication module. Furthermore, the temperature controller can cooperate with an external remote control device through the wireless communication module. The remote control device may be a remote controller or a variety of intelligent terminals, such as a smart phone, etc., to facilitate remote control of the operating state of the baseboard heater of carbon composite material, and completely reduce the waste of electric energy, create an intelligent community and achieve energy conservation and emission reduction.

Still further, the wireless communication module may comprise a WiFi module or a Bluetooth module, etc., and is not limited thereto.

Finally, it is also to be noted that the terms "comprise", "comprising" or "include" or any other variation thereof is intended to cover a non-exclusive inclusion, such that a process, method, article, or apparatus that includes a list of elements includes not only those elements, but also other elements not expressly listed, or elements inherent to such process, method, article, or apparatus.

What is claimed is:

1. A high-performance far-infrared surface heating element of carbon composite material, comprising:

a carbon composite material layer, comprising a film-like material mainly consisted of carbon material with an $sp^2$ hybrid structure, wherein the film-like material has a surface resistance of 0.01 Ω/sq to 100 Ω/sq and a power density of 50~10000 W/m$^2$ at a driving voltage of 1 to 1000 V, when being bent more than one million times, the film-like material has a surface resistance of being maintained at 95% or more, a tensile strength of 50~2000 MPa, a thickness of 1~1000 μm, a temperature rise of 10° C.~250° C., and a high temperature and high humidity resistance change of <5%; and a high thermal stable electronic insulating layer provided on opposite sides of the carbon composite material layer, which has a long-term temperature resistance of 200 to 250° C., a short-term temperature resistance of 300° C., a thickness of 10 to 1000 μm, and a breakdown voltage of greater than 2 KV;

both ends and/or both sides of the carbon composite material layer are provided with at least parallel electrodes for applying a voltage.

2. The high-performance far-infrared surface heating element of carbon composite material according to claim 1, wherein the film-like material has a surface resistance of 0.01 Ω/sq to 10 Ω/sq and a power density of 50~3000 W/m$^2$ at a driving voltage of ≤60V.

3. The high-performance far-infrared surface heating element of carbon composite material according to claim 1, wherein the carbon composite material layer is a graphene film or a composite film of graphene and a resin, which has a thickness of 1 μm to 500 μm, and the graphene in the layered structure has a spacing of >0.34 nm.

4. The high-performance far-infrared surface heating element of carbon composite material according to claim 1, wherein the carbon composite material layer is a film of carbon composite material, a composite film of a carbon composite material and a resin, a carbon fiber film, or a composite film of a carbon fiber and a resin, which has a thickness of 1 μm to 500 μm, and the network structure has a pore having a pore diameter of 1 nm to 50 nm.

5. The high-performance far-infrared surface heating element of carbon composite material according to claim 1, wherein the surface heating element has a thickness of 1 μm to 2 mm.

6. The high-performance far-infrared surface heating element of carbon composite material according to claim 1, wherein the $sp^2$ hybrid structure carbon material comprises any one of or a combination of two or more of a carbon composite material, graphene, carbon fiber, graphite, and conductive carbon black, and the film-like material comprises any one of or a combination of two or more of a heating film of pure carbon composite material, a composite heating film of carbon composite material, an artificial graphite sheet heating film, a graphene heating film, a graphene composite heating film, a graphite composite heating film, a pure carbon fiber woven heating film, and a carbon fiber composite heating film.

7. The high-performance far-infrared surface heating element of carbon composite material according to claim 1, wherein the surface of the carbon composite material layer is provided with a high-performance electronic insulating layer, the high-performance electronic insulating layer comprises any one of or a combination of two or more of a UV hard coating layer, a heat curing hard coating layer, a primer coating, and a top coating, and the constituent material of the high-performance electronic insulating layer comprises any one of or a combination of two or more of an epoxy resin, a rubber, an acrylic resin, a polyurethane resin, and a silicone resin.

8. The high-performance far-infrared surface heating element of carbon composite material according to claim 1, wherein the high-performance far-infrared surface heating element is used for the preparation of a civil heating device or an industrial heating device, the civil heating device comprises any one of or a combination of two or more of a heater, a floor heating structure, a wall heating structure, an electric heating household item, a flexible heating wearing, and an electric boiler, and the industrial heating device comprises any one of or a combination of two or more of a lithium battery module heating element, an industrial pipe heating element, and an industrial device heating element; wherein the floor heating structure, comprising floor or a floor tile provided on the ground, a heat insulating layer, a decorative layer and a high-performance far-infrared surface heating element of carbon composite material according to claim 1, the far-infrared surface heating element is provided under or above the floor or floor tile and between the heat insulating layer or the decorative layer and the floor or the floor tile, the floor or floor tile comprises a solid wood floor, a solid wood multi-layer floor, a laminate floor, a tile, a marble slab or a brick;

the wall heating structure, comprising a baseboard provided on the wall surface, a heat insulating layer, a decorative layer and a high-performance far-infrared surface heating element of carbon composite material according to claim 1, the far-infrared surface heating element is provided on the surface of the baseboard or between the baseboard and the wall surface;

the electric heating household item, comprising:

a fabric or leather, and a high-performance far-infrared surface heating element of carbon composite material according to claim 1, which is bonded to the surface of the fabric or leather and/or provided inside the fabric or leather;

the electric heating household item comprises an electric heating carpet, an electric heating mattress, a piece of electric heating wallpaper or an electric heating mural; wherein, the electric heating carpet comprises a carpet body, and the high-performance far-infrared surface heating element of carbon composite material is provided below the carpet body or inside the carpet body;

the electric heating mattress comprises a mattress body, and the high-performance far-infrared surface heating element of carbon composite material is provided below the mattress body or inside the mattress body;

the electric heating wallpaper comprises a wallpaper body, and the high-performance far-infrared surface heating element of carbon composite material is provided at the inner side of the wallpaper body or inside the wallpaper body; and the electric heating mural comprises a mural body, and the high-performance far-infrared surface heating element of carbon composite material is provided at the inner side of the mural body or inside the mural body;

or, the electric heating household item comprising an electric heater, wherein electric heater comprises a heater housing and a blower, and the heater is provided with the high-performance far-infrared surface heating element of carbon composite material according to claim 1.

9. A heating element of carbon composite material, comprising a heating film of carbon composite material and a heat sink, wherein at least one side surface of the heating film of carbon composite material is attached and thermally connected to the heat sink, and the heating film of carbon composite material is electrically connected to the electrode, wherein the heating film of carbon composite material comprises a film of carbon composite material formed by aggregation of a plurality of carbon composite materials.

10. The heating element of carbon composite material according to claim 9, wherein two opposite side surfaces of the heating film of carbon composite material are attached and thermally connected to the heat sink, or the heating film of carbon composite material is sandwiched between two heat sinks.

11. The heating element of carbon composite material according to claim 9, wherein the heating element of carbon composite material is a paper-folded structure as a whole, as the heating film of carbon composite material and the heat sink also have a paper-folded structure, while an angle formed between the two parts of the heating film of carbon composite material or the heat sink separated by any one of the fold lines is 5° to 170°.

12. The heating element of carbon composite material according to claim 9, wherein the heating element of carbon composite material has an overall thickness of 0.1 to 50 mm and an overall height of 50 to 150 mm, as the heating element of carbon composite material has a power of 10 to 1000 W/m.

13. A heater of carbon composite material, comprising:

a housing having an air inlet and an air outlet, wherein the air inlet and the air outlet are in communication with an airflow passage distributed in the housing;

the heating element of carbon composite material according to claim 9, wherein at least one heat sink of the heating element of carbon composite material is at least partially arranged in the airflow passage;

a connector configured to fixedly connect the housing to the wall and/or the ground.

14. The heater of carbon composite material according to claim 13, wherein the housing is provided with an automatic baffle at least configured to be engaged with the air inlet and/or the air outlet, and/or a heat insulating reflective film is provided between the inner wall of the housing and the heating element of carbon composite material.

15. The heater of carbon composite material according to claim 13, wherein the baseboard heater of carbon composite material further comprises an electrostatic precipitator and/or a negative ion generating device, the electrostatic precipitator is distributed at the air inlet and/or the air outlet, the negative ion generating device is distributed at the air outlet and the air outlet and the air inlet are provided at an upper part and a lower part of the housing, respectively.

16. The baseboard heater of carbon composite material according to claim 13, wherein the baseboard heater of carbon composite material further comprises an intelligent thermostat, which comprises a temperature controller, a temperature sensor, a power regulating component, an overheating protection device and a wireless communication module, wherein the temperature sensor is at least configured to monitor the temperature of the heating film of carbon composite material and/or the surrounding environment, both of the temperature sensor, the power regulating component, the overheating protection device and the wireless communication module are connected to the temperature controller, the power regulating component is also connected to the heating film of carbon composite material.

17. The baseboard heater of carbon composite material according to claim 16, wherein the overheating protection device comprises a point-like overheating protection switch, a block-like overheating protection switch or a linear overheating protection switch.

18. The baseboard heater of carbon composite material according to claim 16, wherein the intelligent thermostat further comprises a wireless communication module, the temperature controller is connected to the wireless communication module, and the wireless communication module comprises a WiFi module or a Bluetooth module.

19. The heater of carbon composite material according to claim 13, wherein the heating element of carbon composite material is a paper-folded structure as a whole, and an angle formed between the two parts of the heating film of carbon composite material separated by any one of the fold lines is 5° to 170°, while any one of the fold lines on the heating element of carbon composite material extends along a direction of travel of the airflow within the airflow passage.

20. The baseboard heater of carbon composite material according to claim 13, wherein the heating element of carbon composite material has an overall height of 50 to 150 mm, the heating element of carbon composite material has an overall height of 70 to 100 mm and an overall thickness of 8 to 50 mm.

* * * * *